United States Patent [19]

Palau et al.

[11] 4,387,741

[45] Jun. 14, 1983

[54] ROTARY DOBBIES FOR WEAVING LOOMS

[75] Inventors: Joseph Palau, Duingt; Pierre Bourgeaux, Poisy, both of France

[73] Assignee: S.A. des Etablissements Staubli, Faverges, France

[21] Appl. No.: 244,483

[22] Filed: Mar. 16, 1981

[30] Foreign Application Priority Data

Mar. 20, 1980 [FR] France ..... 80 06545

[51] Int. Cl.[3] ..... D03C 1/00

[52] U.S. Cl. ..... 139/66 R; 139/76

[58] Field of Search ..... 139/76, 66 R–74

[56] References Cited

FOREIGN PATENT DOCUMENTS

| | | | |
|---|---|---|---|
| 2909131 | 9/1980 | Fed. Rep. of Germany | 139/76 |
| 2942573 | 3/1981 | Fed. Rep. of Germany | 139/76 |
| 1503775 | 10/1967 | France . | |
| 2014628 | 5/1972 | France . | |
| 2398229 | 2/1979 | France . | |
| 320577 | 1/1972 | U.S.S.R. | 139/66 R |
| 681125 | 8/1979 | U.S.S.R. | 139/76 |

*Primary Examiner*—James Kee Chi

*Attorney, Agent, or Firm*—Dowell & Dowell

[57] ABSTRACT

The present invention relates to the system of angular connection of the eccentric of each element of a dobby either with the shaft or with the corresponding arm. This connection is ensured by a double hook borne by the eccentric and mounted to rock so that one or the other of its noses engages in a notch made in the periphery of a driving device fixed to the shaft, or in a notch in a bead of the arm.

5 Claims, 6 Drawing Figures

ROTARY DOBBIES FOR WEAVING LOOMS

The present invention relates to dobbies of the rotary type for the formation of the shed on weaving looms.

In rotary dobbies, the raising and lowering actuating movement of the heddle frames is known to be achieved not by double swinging levers actuated by knives with reciprocating movement, but by connecting arms controlled by eccentrics mounted on the main shaft of the system. This shaft is driven by an intermittent movement of rotation and, at each stop, i.e. every half-revolution of the said shaft, the reading device must, at each of the elements of the dobby (i.e. the actuating assembly associated with each heddle frame) and as a function of the design or weave to be obtained on the fabric in the course of weaving, connect the eccentric either with said shaft to control the connecting arm, or with the connecting arm in order to effect angular immobilisation thereof.

In the conventional constructions, the above-indicated selective connection is generally effected for each element of the dobby with the aid of a rocking hook system borne by the eccentric and arranged to cooperate with impressions made respectively in the main shaft and in the arm. It will be readily understood that such a system, adapted to withstand very considerable stresses in the course of functioning of the dobby and the loom, is not easily accessible due to its location. This difficulty of access complicates both the maintenance and repair operations of the rocking hook system and the control of the latter by the reading device.

The improvements forming the subject matter of the present invention aim at remedying this drawback and at enabling a rotary dobby of simpler and more reliable construction to be produced.

The invention consists mainly in mounting each rocking connection hook on a lug provided on the corresponding eccentric to project laterally and radially from the periphery thereof, the hook being engaged in an opening in the lug, and in causing said hook to cooperate with notches made in the periphery of a driving device or disc of large diameter fixed to the intermittently rotating shaft and also in a lateral annular boss in the arm.

This particular arrangement makes it possible to house the selective connection system at a relatively great radial distance from the main shaft, this facilitating its control by the reading device and facilitating maintenance and repair operations, and considerably reducing the stresses applied to said system.

It will further be noted that, due to the presence of laterally adjacent confining discs or driving devices, the bearings interposed between the shaft and each eccentric on the one hand, and between this eccentric and the opening of the corresponding arm on the other hand, will be retained and may be easily and inexpensively constituted by cylindrical roller bearing cages abutting on likewise cylindrical races.

The invention will be more readily understood on reading the following description with reference to the accompanying drawings, in which:

FIG. 1 is a transverse section showing the arrangement of one of the elements of a rotary dobby according to the invention.

FIG. 2 reproduces FIG. 1 after the main shaft of the dobby has moved through 180°.

Figure 1:
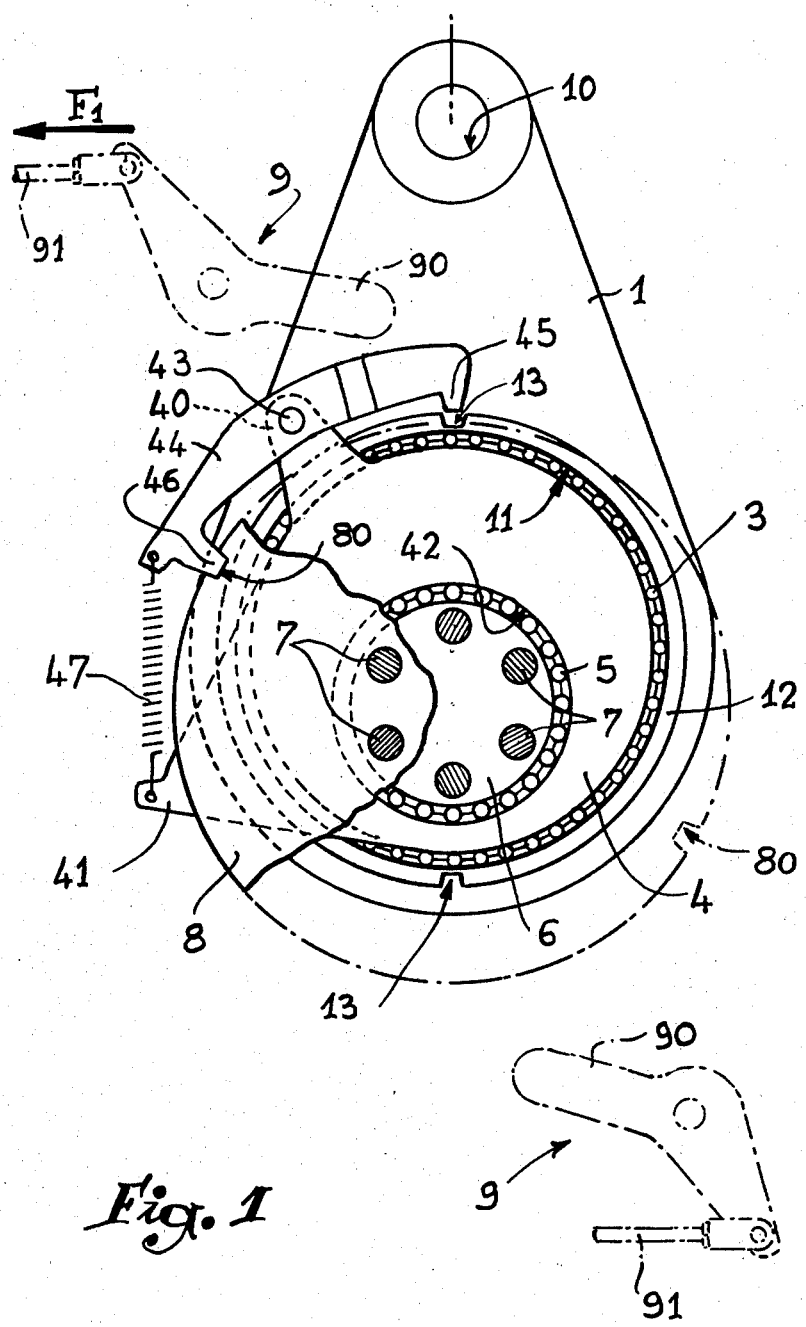

Referring now to the drawings, reference 1 denotes the arm actuating each of the elements of the dobby, this arm comprising a perforation 10 (FIGS. 1, 2 and 3) for coupling it by cable or linkage with the corresponding heddle frame. As shown more particularly in FIG. 4, each arm 1 presents, opposite the perforation 10 an opening 11 of large diameter, about which is concentrically provided, on one of the sides of said arm, an annular boss or bead 12; the periphery of this bead 12 is provided with two diametrically opposite notches 13.

Figure 2:
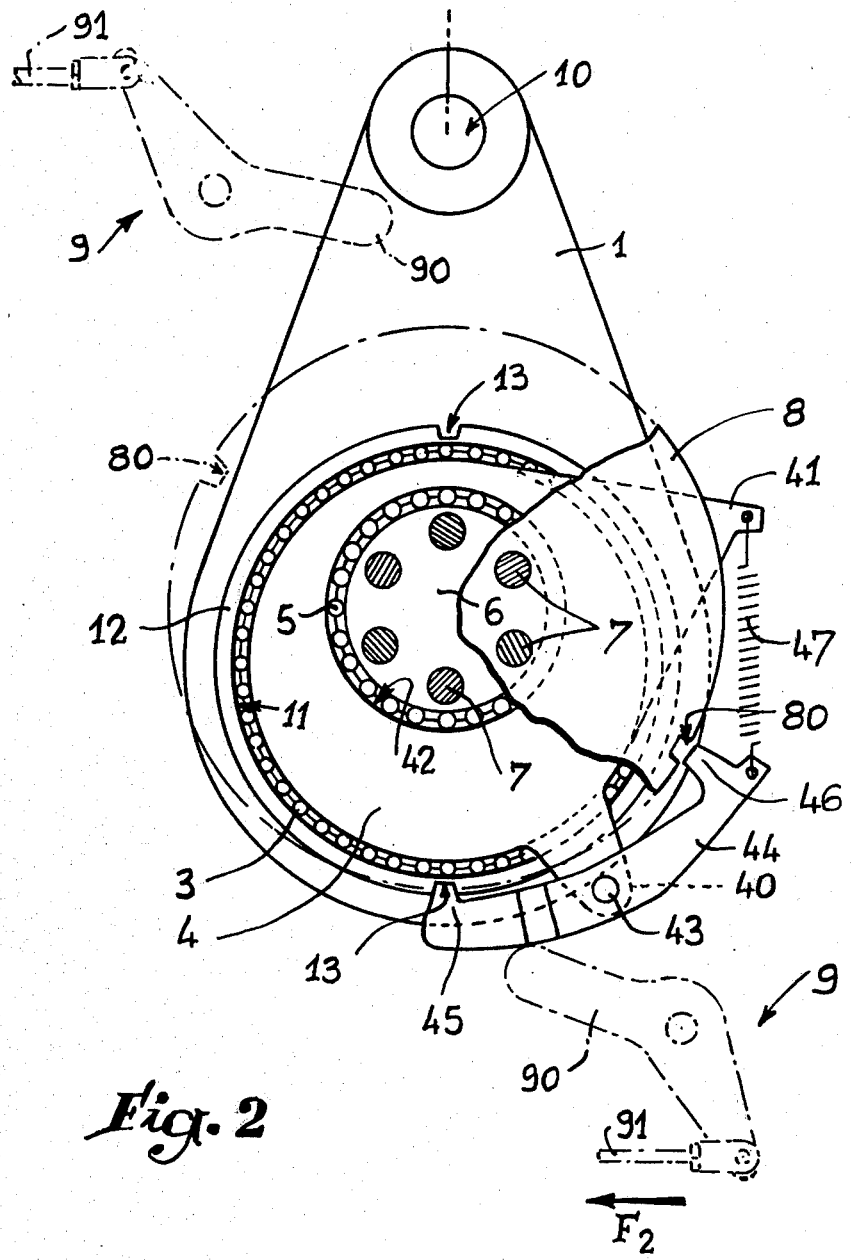
Figure 3:
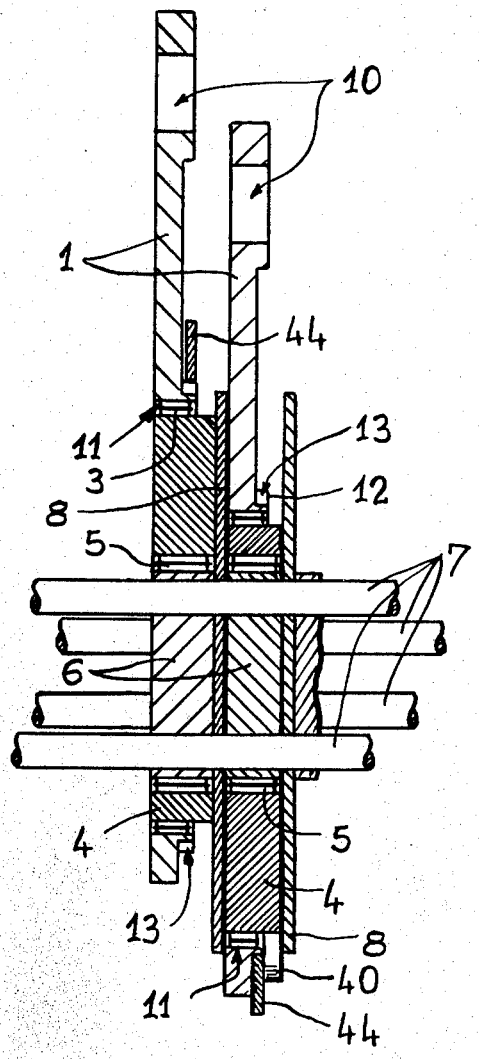
FIG. 3 is a longitudinal section through the dobby, two elements only having been shown.
Figure 4:
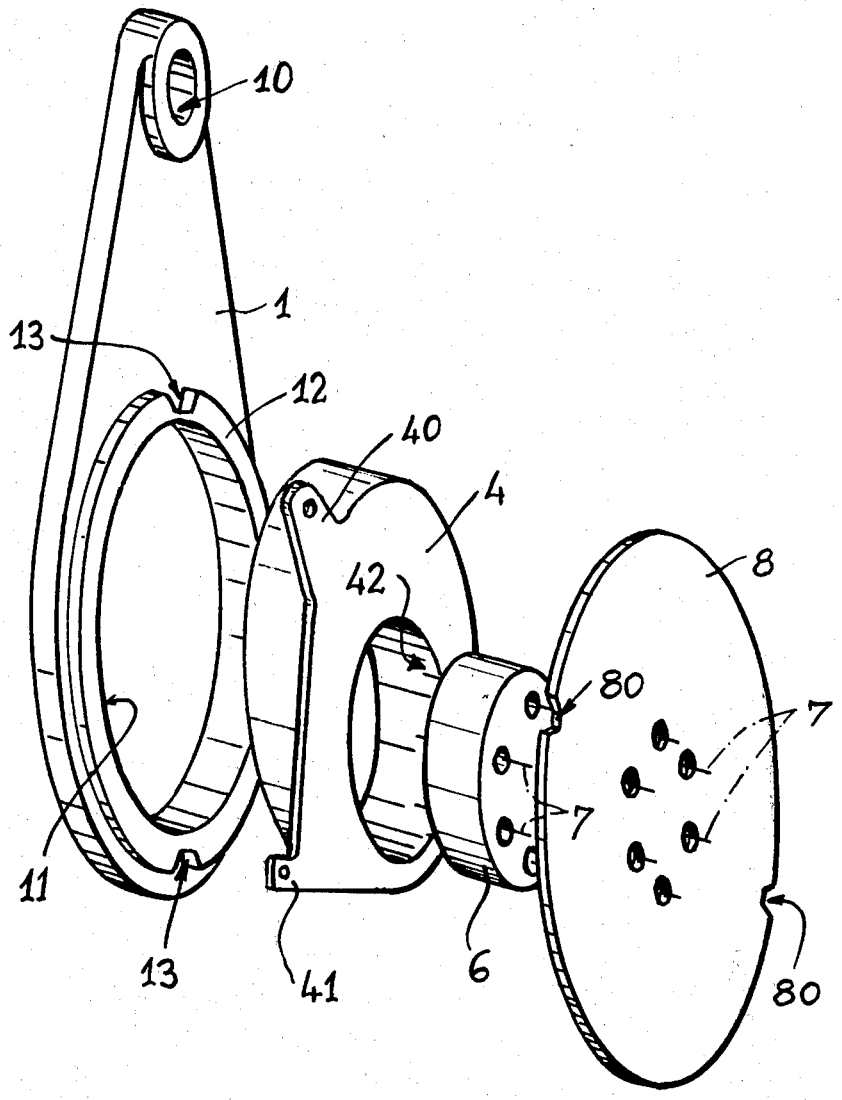
FIG. 4 is an exploded perspective view showing the main pieces of a element of the dobby.

In the opening 11 of each connecting arm 1 is engaged, with interposition of a bearing such as the bearing referenced 3 in FIGS. 1 to 3, an eccentric 4 having an outer surface and having an axial length greater than that of the opening 11 so as to project laterally outside said opening and supporting two radial lugs 40 and 41. The eccentric opening 42 of the eccentric 4 houses, likewise with the interposition of a bearing 5, a cylindrical piece 6. The pieces 6 of the different elements of the dobby are assembled axially with one another by tie rods 7, the assembly 6-7 thus obtained constituting the main shaft. Between two contiguous pieces 6 is intercalated a circular disc or driving device 8 through which the tie rods 7 pass so as to move angularly with the shaft 6-7; each driving device 8 is provided on its periphery with two diametrically opposite notches 80.

Figure 5:
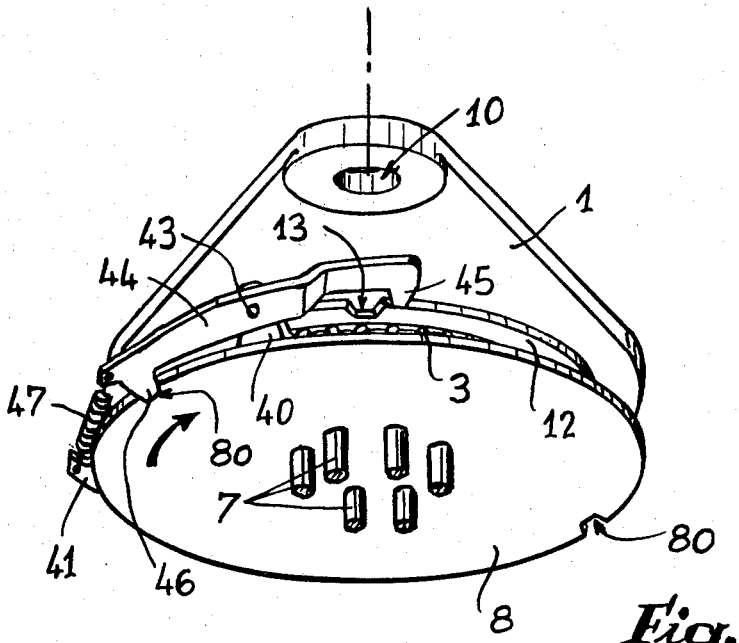
FIGS. 5 and 6 are perspective plan views showing the double connecting hook in its two positions of functioning.
Figure 6:
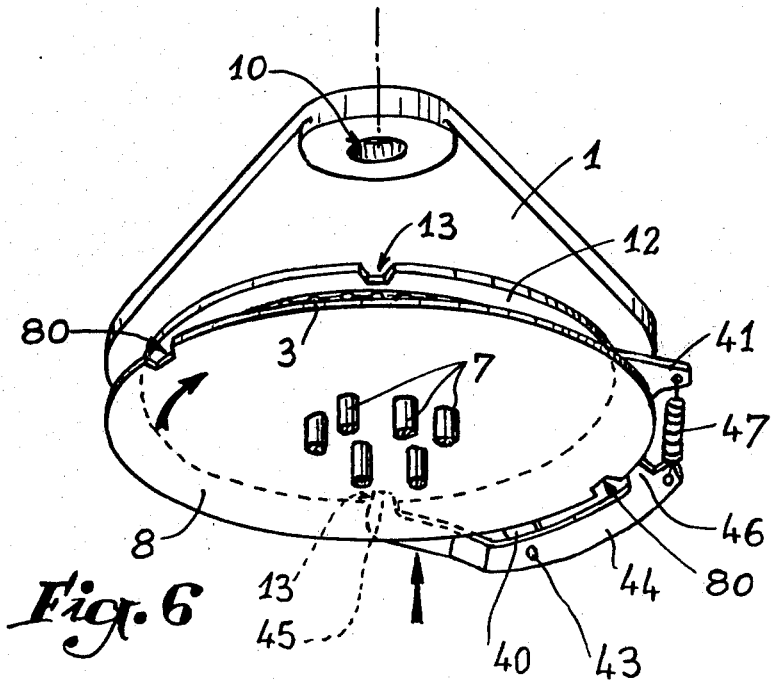

The lug 40 of each eccentric 4 is pierced in order to receive a pin 43 (FIGS. 1 and 2) forming support for a rocking hook 44. The latter is provided in double ended form and has at its ends two noses 45 and 46. Furthermore, it is bent transversely so that the nose 45 is located opposite the bead 12 whilst the nose 46 is disposed opposite the corresponding disc or driving device 8, as shown in FIGS. 5 and 6. It should be observed that the hook 44 is subjected to the continuous action of a return spring 47 interposed between the lug 42 of the eccentric 4 and the end of the rocking hook which bears the nose 46.

It will also be noted that the driving devices 8 present an outer diameter which is at least equal to that of the bead 12 in order to cover the bearings 3 and 5 laterally.

The general functioning of the dobby will follow from the foregoing explanations and will be readily understood.

The intermittent rotation of the shaft 6-7 is programmed so that, at each stop period, all the hooks 44 of the dobby are positioned opposite one or the other of two control stations, referenced 9 in FIGS. 1 and 2 and diametrically opposite one another with respect to the main shaft 6-7. Each of these stations 9 comprises a number of actuating members equal to that of the elements of the dobby, each member being arranged to make the double hook 44 rock, under the effect of the reading device of the dobby, against its return spring 47. In the drawings, this member has been shown in the form of a pivoting bent arm 90, coupled to the reading device by a small rod 91 of reciprocating movement.

In FIG. 1, it has been assumed that, under the effect of the reading device, the small rod 91 moved in the direction of arrow F1 so that the end of the bent arm 90 of the upper station 9 is remote from the hook 44 as shown. The spring 47 therefore engages the nose 46 in one of the two notches 80 of the driving device 8. Under these conditions, when the shaft 6-7 starts to rotate again with the driving device 8, the eccentric 4 which is journaled thereon is obliged to move angularly with said shaft, this having for its effect to drive the corresponding arm 1 which is jounaled on the eccentric 4 with a reciprocatory movement which causes the corresponding frame to rise. It will be noted that, as soon as the eccentric 4 starts to rotate, the nose 45 of the hook 44 slides along the periphery of the bead 12 which opposes any untimely disengagement of the nose 46 by sudden rocking of the hook against the return spring 47.

The hook 44 stops, in any case, lower the opposite station 9 (FIG. 2). If the reading device has actuated the bent arm 90 of this station to permit the hook 44 to remain free, under the action of the spring 47, to maintain the nose 46 in the notch 80, the arm will make a fresh oscillation under the effect of the rotation of the eccentric 4, causing the descent of the heddle frame associated therewith. If, on the contrary, and as has been assumed in FIG. 2, the reading device controls the rod 91 of the lower station 9 in the direction of arrow F2, the hook 44 rocks and its nose 45 engages in the corresponding notch 13 of the bead 12 of the arm, said notch being located opposite said nose due to the angular offset arranged between the pairs of notches 80—80 and 13—13 (this offset being equal to the angular amplitude defined by the two noses 45 and 46 of each double hook 44). The eccentric 4 remains immobile angularly and through the hook 44 ensures the angular holding of the arm 1 which can therefore not move in untimely manner under the effect of the weight of the heddle frame.

It will be further noted that, once the nose 45 is engaged in the notch 13 under the effect of the bent arm 90, the hook 44 cannot rock under the effect of the spring 46 due to the sliding contact of the nose 46 against the periphery of the driving device 8, this being so until the latter presents a notch 80 again opposite said nose 46.

It will be understood that the above-described construction is particularly robust, due in particular to the fact that the selective connecting system constituted by the double hook 44 acts at the periphery of each driving device 8, i.e. at a relatively great radial distance from the main shaft 6-7; the tangential effort transmitted is consequently less great than when connection is effected at shaft level. Moreover, the accessibility is considerably improved since the rocking hooks 44 are disposed outside the eccentrics.

It will further be noted, as has been emphasized hereinabove, that the intermediate bearings 3 and 5 may be of highly simplified structure due to the lateral retaining effected by the driving devices 8.

It must, moreover, be understood that the preceding description has only been given by way of example and that it in no way limits the domain of the invention. The replacement of the details of execution described by any other equivalents will not depart from the scope of the invention. In particular, the stations 9 may be in multiple forms (mechanical control by pattern card or by punched card, electromagnetic control, electronic control, etc . . . ). It is also obvious that these stations 9 may be arranged to ensure a positive control of the double hooks 44 in both direction of rocking, thus supplementing in one direction the biasing action of the return springs 47 or even enabling these latter to be dispensed with.

What is claimed is:

1. In a dobby of the rotary type having a dobby element for actuating each heddle frame of a weaving loom, the loom having a main shaft driven with intermittent rotational motion and having a reading device having control members located at element control stations adjacent to the shaft, each heddle frame actuating element comprising:

a connecting arm operative to actuate a heddle frame, the arm having a central opening loosely surrounding the shaft;

an eccentric member between the shaft and the connecting arm and having an outer surface on which the connecting arm is journaled at its central opening, and having an inner opening surrounding the shaft and journaled thereon, the inner opening being disposed eccentrically with respect to said outer surface, and the eccentric member having a pivot lug extending radially therefrom and offset laterally from said bead on the arm;

a driving disc carried by the shaft adjacent to the eccentric member and of diameter larger than the shaft, and the outer periphery of the driving disc having annularly spaced notches thereon; and a rocking hook pivotally supported by the lug on the eccentric member and having a notch-engaging nose on one side of the pivot disposed opposite the periphery of the disc, the rocking hook when located at a control station of the reading device being disposed to be selectively rocked by a control member to engage its nose into a notch of the periphery of the disc in order to couple the main shaft with the eccentric member.

2. In a dobby actuating element as claimed in claim 1, the connecting arm having an annular bead having an outer periphery surrounding the central opening, this outer periphery having annularly spaced notches thereon, the rocking hook having a second notch engaging nose on the other side of the pivot adjacent to the periphery of the bead, the periphery of the driving disc being located on the other side of the eccentric member pivot lug from the periphery of the bead, and the noses of the rocking hook being oppositely offset laterally from the pivot lug respectively to overlie said peripheries whereby the rocking hook couples the connecting arm to the eccentric when its corresponding nose engages into a notch in the outer periphery of the bead under the action of the control member at a control station.

3. In a dobby actuating element as claimed in claim 1, the eccentric member carrying spring-supporting lug means, and spring means disposed between said lug means and the rocking hook and operative to bias the hook normally to engage its nose in a notch on the corresponding periphery.

4. In a dobby actuating element as claimed in claim 2, said peripheries respectively being of such diameters that when one nose of the rocking hook is engaged in a notch in one periphery, the other periphery slides under the other nose and prevents disengagement of said one nose from its notch until a notch in the other periphery falls opposite said other nose.

5. In a dobby actuating element as claimed in claim 1, roller bearing means interposed between the outer surface of the eccentric member and the opening in the arm, and interposed between the inner opening of the eccentric member and the shaft, and the driving discs associated with mutually adjacent dobby actuating elements abutting the ends of the roller bearing means and being of diameter sufficient to retain them in place.

* * * * *